US008061105B2

(12) United States Patent
Haga

(10) Patent No.: US 8,061,105 B2
(45) Date of Patent: Nov. 22, 2011

(54) PROJECTED CORNER STRUCTURE OF BUILDING AND INDOOR RECESSED WALL STRUCTURE

(75) Inventor: Tadashi Haga, Tokyo (JP)

(73) Assignee: Yoshino Sangyo Co., Ltd., Tokyo (JP)

( * ) Notice: Subject to any disclaimer, the term of this patent is extended or adjusted under 35 U.S.C. 154(b) by 0 days.

(21) Appl. No.: 11/913,904

(22) PCT Filed: Sep. 5, 2005

(86) PCT No.: PCT/JP2005/016213

§ 371 (c)(1),
(2), (4) Date: Nov. 8, 2007

(87) PCT Pub. No.: WO2007/026431

PCT Pub. Date: Mar. 8, 2007

(65) Prior Publication Data

US 2009/0077915 A1 Mar. 26, 2009

(30) Foreign Application Priority Data

Aug. 31, 2005 (JP) ..... 2005-251509

(51) Int. Cl.
*E04C 2/00* (2006.01)

(52) U.S. Cl. ..... 52/631; 52/288.1; 52/275; 52/254

(58) Field of Classification Search ..... 52/288.1, 52/287.1, 255, 282.3, 282.1, 272, 254, 275, 52/278, 256, 257, 631
See application file for complete search history.

(56) References Cited

U.S. PATENT DOCUMENTS

| | | | | |
|---|---|---|---|---|
| 2,373,789 | A * | 4/1945 | Smith | 52/282.3 |
| 3,440,790 | A * | 4/1969 | Nerem | 52/631 |
| 3,525,188 | A * | 8/1970 | Torbett | 52/288.1 |
| 3,559,356 | A * | 2/1971 | Koral | 52/254 |
| 3,712,003 | A * | 1/1973 | Hallock et al. | 52/254 |
| 3,717,968 | A * | 2/1973 | Olsen et al. | 52/288.1 |

(Continued)

FOREIGN PATENT DOCUMENTS

JP 8-2257 Y2 1/1996

(Continued)

OTHER PUBLICATIONS

International Search Report dated Dec. 6, 2005 (two (2) pages).

*Primary Examiner* — Eileen D Lillis
*Assistant Examiner* — James Ference
(74) *Attorney, Agent, or Firm* — Crowell & Moring LLP

(57) ABSTRACT

A projected corner structure in which two upright columns 3 and 4 substantially rectangular in cross section are disposed on a diagonal line in a pair of bracket-shaped runners (1, 2) arranged at an angle of about 90° on a floor surface. A corner upright column 5 of a synthetic resin including an outer end portion 5*b* having an outer surface formed in the form of a circular arc stands upright fitted into a substantially angular clearance C formed on an exterior side between the upright columns. Projecting portions 9 and 10 are formed integrally on lateral portions on both sides of the corner upright column, and are arranged to fit over interior side surfaces of the respective upright columns, and are fastened to the upright columns by countersunk screws 11 and 12. The resulting structure combines simplified construction with increased strength, improved appearance, and decreased cost.

18 Claims, 9 Drawing Sheets

U.S. PATENT DOCUMENTS

| | | | | | |
|---|---|---|---|---|---|
| 4,104,839 | A * | 8/1978 | Balzer et al. | 52/288.1 |
| 4,161,853 | A * | 7/1979 | Weiss et al. | 52/288.1 |
| 4,189,885 | A * | 2/1980 | Fritz | 52/287.1 |
| 4,621,471 | A * | 11/1986 | Kuhr et al. | 52/288.1 |
| 4,638,606 | A * | 1/1987 | Wendt | 52/36.6 |
| 4,689,930 | A * | 9/1987 | Menchetti | 52/277 |
| 4,706,426 | A * | 11/1987 | Rumsey | 52/232 |
| 4,843,771 | A * | 7/1989 | Chapman et al. | 52/288.1 |
| 5,138,810 | A * | 8/1992 | Kartler | 52/254 |
| 5,363,617 | A * | 11/1994 | Miller | 52/288.1 |
| 5,542,222 | A * | 8/1996 | Wilson et al. | 52/287.1 |
| 5,664,376 | A * | 9/1997 | Wilson et al. | 52/287.1 |
| 5,806,253 | A * | 9/1998 | Nelson | 52/179 |
| 5,813,179 | A * | 9/1998 | Koenig et al. | 52/255 |
| 6,176,637 | B1 * | 1/2001 | Hatlan et al. | 403/231 |
| 6,219,980 | B1 * | 4/2001 | Peck, Jr. | 52/288.1 |
| 6,311,442 | B1 * | 11/2001 | Watanabe | 52/282.3 |
| 6,427,418 | B1 * | 8/2002 | Zell | 52/745.05 |
| 6,553,732 | B2 * | 4/2003 | Shaw | 52/287.1 |
| 6,619,008 | B1 * | 9/2003 | Shivak et al. | 52/282.1 |
| 6,758,017 | B2 * | 7/2004 | Young | 52/255 |
| 7,104,024 | B1 * | 9/2006 | diGirolamo et al. | 52/710 |
| 2003/0037495 | A1 * | 2/2003 | Shaw | 52/287.1 |
| 2004/0200172 | A1 * | 10/2004 | Beck et al. | 52/506.03 |
| 2005/0246986 | A1 * | 11/2005 | Dugger | 52/287.1 |

FOREIGN PATENT DOCUMENTS

| | | | |
|---|---|---|---|
| JP | 2522754 | B2 | 5/1996 |
| JP | 2961248 | B2 | 8/1999 |
| JP | 2001-49763 | A | 2/2001 |
| JP | 2001-90312 | A | 4/2001 |

* cited by examiner

PROJECTED CORNER STRUCTURE OF BUILDING AND INDOOR RECESSED WALL STRUCTURE

TECHNICAL FIELD

The present invention relates to an improvement in a projected corner structure and a recessed wall structure formed on an interior side by bars such as upright columns in a building such as a house.

BACKGROUND ART

As is well known, for four corners in a room of a building such as a house, there are formed projected corners (corner portions) projected inwards with upright columns and interior member. The Japanese patent document mentioned below shows a conventional projected corner structure.

In this conventional projected corner structure, an upright column is composed of a lip angle steel member and two lip channel steel members provided so as to contact with two orthogonal surfaces of the lip angle steel member. A clearance heat insulating material is provided in the inside of the lip angle steel member so as to fill the inside of the lip angle steel member.

On the inner side of the projected corner, there are provided damp-proof sheets supported by frame members at an orthogonal state. An auxiliary upright column having a rectangular cross section is disposed between the confronting frame members crossing each other at right angles. Accordingly, the projected corner mentioned is formed so as to have a substantially rectangular cross section.

The Japanese patent document referred to is Published Japanese Patent Specification Publication No. 2001-49763.

DISCLOSURE OF INVENTION

Problem(s) to be Solved by the Invention

A projected corner structure is conventionally angled in cross section approximately in the form of a right angle with an upright column and an auxiliary column for a building, as mentioned before.

Such a right-angled corner tends to increase the possibility of interference of the right-angled corner edge with certain people, such as a person with a disability, an aged person, or a child walking in a room. When cleaning in a room, for example, the right-angled edge of the projected corner structure tends to hamper the cleaning by abutment with a T-shaped forward end of a cleaner, and might damage the forward end of the cleaner.

Furthermore, the right-angled corner edge imposes a limitation on the space in a room, and tends to deteriorate the appearance quality.

It is possible to form the projected corner in the form of a circular arc. In one such construction, a board as a underlayment is curved into the arc-shaped form. In another construction, the arc shape is formed by combination of a plurality of runners.

However, the board requires a special board for the circular arc, and hence increases the cost.

Forming the arc shape by combining runners complicates the construction process by requiring operations for positioning each of the runners, and hence increases the cost.

The present invention has been developed in view of technical problems in the conventional projected corner structure. An object of the invention is to provide a projected corner structure adequate for improving the accuracy in construction and the efficiency in working operations by utilizing a general corner upright column in combination with each upright column, and for reducing the cost.

Means for Solving the Problems

According to the invention, at least two upright columns, which are substantially rectangular in cross section are disposed in proximity to each other substantially on a diagonal line, and a corner upright column, which includes an outer surface shaped in the form of a circular arc, is fixed upright in a fitting state in a clearance, which is formed on an outer side between the two upright columns and is substantially triangular in cross section.

According to this invention, it is possible to form an arc-shaped corner portion with the corner upright column fixed fittingly between the two upright columns. Moreover, it is possible to ensure a sufficient strength of the projected corner structure by forming the projected corner structure with at least three upright columns.

Moreover, the operation of merely combining the upright columns simplifies the construction process. By using a standardized generally-used material, it is possible to restrain a cost increase sufficiently.

The arc-shaped corner portion of the projected corner can provide comfortable living space with expanse and softness, and improve the safety of a person with a disability during walking.

According to certain features of invention, a projected corner structure applied to a hanging wall projects downwards from a ceiling. In this projected corner structure, at least two lateral columns, which are substantially rectangular in cross section, are disposed in proximity to each other substantially on a diagonal line, and a corner lateral column including an outer surface shaped in the form of a circular arc is fixed laterally in a fitting state in a clearance, which is formed on an outer side between the two lateral columns and is substantially triangular in cross section.

This invention can provide the same effects as mentioned previously.

According to other features of the invention, the corner upright column and the corner lateral column are made of a hard synthetic resin, respectively.

According to other features of the invention, it is possible to form the corner upright column and the corner lateral column continuously by extrusion. Therefore, it is possible to improve the efficiency of the forming operations and to decrease the cost in terms of material.

According to other features of the invention, an underlayment member is provided on an outer surface of each of the upright columns, and the corner upright column is provided, on both lateral sides, with projecting portions abutting, respectively, on ends of the underlayment members, with each including an outer surface continuous with an outer surface of a corresponding one of the underlayment members.

According to this invention, by setting the wall thickness of the projecting portions substantially equal to the wall thickness of a standard gypsum board, it is possible to form the arc-shaped outer surface of the corner upright column and the outer surfaces of the boards into a smooth continuous outer surface, and therefore, to improve the finished quality of interior material, such as vinyl cloth, attached to the outer surfaces.

According to other features of the invention, an underlay member is provided on an outer surface of each of the lateral columns, and the corner lateral column includes projecting portions, which are located, respectively, on an upper side and a lower side of the corner lateral column, which abut, respectively, on ends of the underlay members and which includes outer surfaces each continuous with an outer surface of a corresponding one of the underlay members.

This invention can provide the same effect as the invention with the underlayment member provided on an outer surface of each of the upright columns.

According to other features of the invention, the upright columns and the corner upright column are joined together by fastening means.

According to other features of the invention, the lateral columns and the corner lateral column are joined together by fastening means.

These particular features further increase the strength of the projected corner with the fastening means which increases the joint rigidity of the upright columns and corner upright column, or the lateral columns and corner lateral column.

According to other features of the invention, a column forming a corner portion of a projected corner includes a main column portion which is bent substantially into an L-shaped form, and a fan-shaped arc column portion which is formed integrally with the main column portion on an outer side of the main column portion and which includes an outer surface curved substantially in the form of a circular-arc along the corner. End portions of the main column portion are bracket-shaped in cross section and are fit fixedly, respectively, in lower and upper runners.

According to this invention, it is possible to form an arc-shaped corner portion with the arc-shaped outer surface of the arc column portion. Moreover, it is possible to ensure a sufficient strength of the projected corner structure by forming the projected corner structure with the column formed integrally with the main column portion and arc column portion.

Moreover, the strength of the entire projected corner portion is further improved by fitting and fixing the end portions of the main column portion in the runners, respectively.

Moreover, the main column portion and arc column portion are formed integrally. The construction is easy, and cost increases are restrained by using, as the corner upright column, a standardized general material.

According to other features of the invention, an interior recessed wall structure forming an opening of a substantially rectangular recess, recessed in one of a is ceiling surface and an inner wall surface inside a room, comprises at least two lateral beam members, which are substantially rectangular in cross section, which form a border of the opening, and which are disposed in proximity to each other substantially on a diagonal line, and a corner lateral beam member, which includes an outer surface shaped in the form of a circular arc and is fit fixedly in a clearance, which is formed on an outer side between the two lateral beam members.

According to this invention, in forming a substantially rectangular recessed wall in a wall or a ceiling in a room, the opening of this recessed wall is formed by fixing the corner lateral beam member fittingly between the two lateral beam members, and the corner portion of the opening of the recessed wall is formed so as to have an arc-shaped surface. Therefore, this structure can increase the strength around the opening of the recessed wall, and improve the quality of the appearance by softening the interior atmosphere as compared to a right-angled surface.

Furthermore, the assemblage of the lateral beam members facilitates construction, and the use of a standardized general material restrains the cost increase.

BEST MODE(S) FOR CARRYING OUT THE INVENTION

The following is a detailed explanation of a projected corner structure for a building according to the present invention, based on the drawings.

Figure 1:
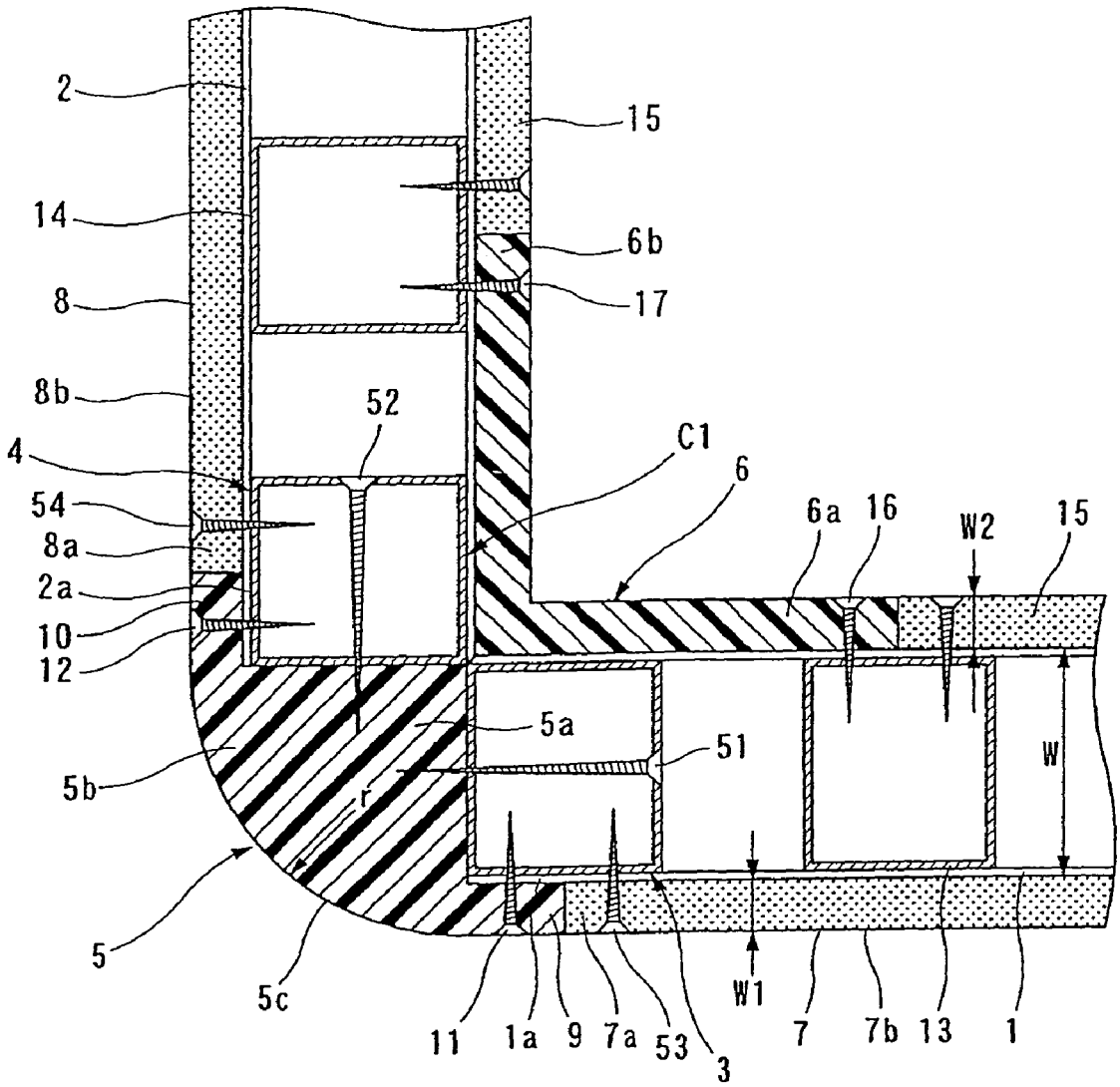
FIG. 1 is a plan view showing a main portion of a first embodiment of a projected corner structure according to the invention.

FIG. 1 shows a projected corner structure according to a first embodiment of the invention. This embodiment is applied to a upright column in an ordinary house, as an example.

Figure 2:
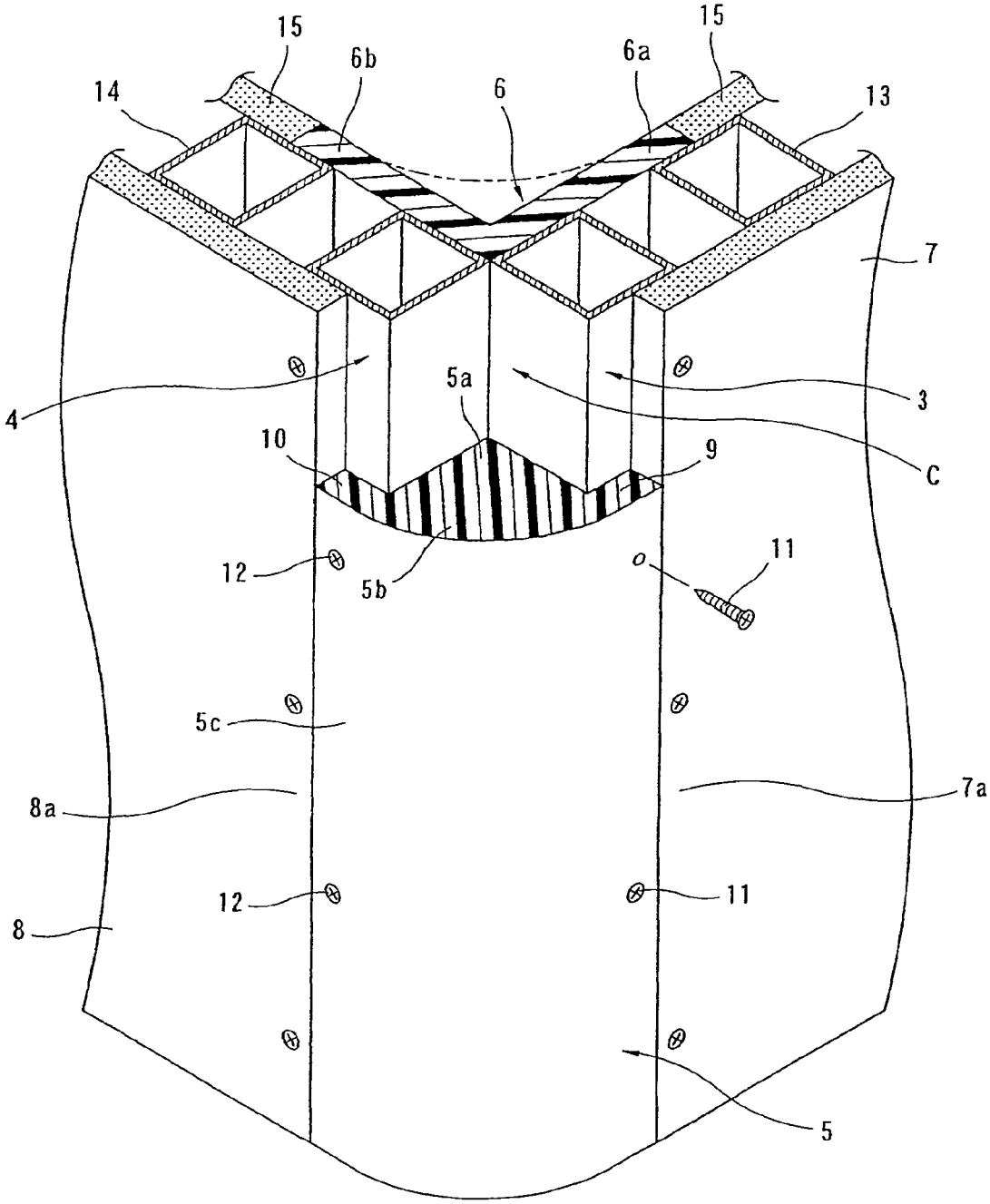
FIG. 2 is a perspective view showing the main portion of the first embodiment.
Figure 3:
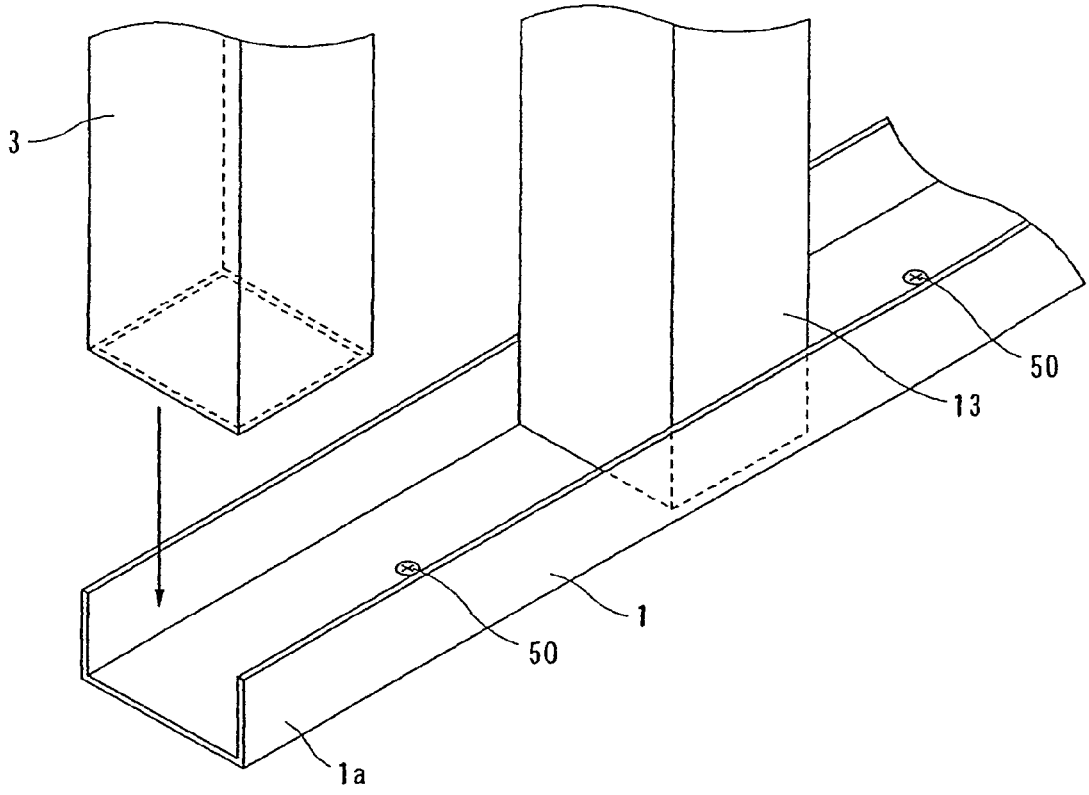
FIG. 3 is an exploded perspective view partially showing a runner and a upright column in the first embodiment.

As shown in FIGS. 1~3, this projected corner structure includes long straight runners 1 and 2 arranged in an orthogonal state on a floor's side or a ceiling's side of one of four corners defining a room; two upright or vertical columns or bars 3 and 4 standing upright in confronting butting end portions of the runners 1 and 2; a corner upright or vertical column or bar 5 fixed on an interior side or in-room side between the upright columns 3 and 4; and a recessed corner upright or vertical column or bar 6, which is fixed in a recessed or concave corner on an exterior side outside the room between the upright columns 3 and 4, and which is approximately L-shaped in cross section.

As shown in FIG. 3, each of the runners 1 and 2 is a thin metal plate or sheet bent by press forming into a channel which is shaped like a square bracket, which opens upwards and which has a width W approximately equal to 45 mm. Each runner 1 or 2 extends straight between corners. The confronting end portions 1*a* and 2*a* of runners 1 and 2 are arranged substantially at an angle of 90 degrees in a butting state in which the edges of runners 1 and 2 abut each other, and are fixed to a concrete floor surface by a plurality of concrete screws 50.

Each of the upright columns 3 and 4 is a thin metal plate or sheet bent into a shape having a rectangular cross section, and the length of one side (width) is slightly shorter than about 45 mm: Each upright column 3 or 4 extends straight in an up and down direction. The lower end of each upright column 3 or 4 is inserted substantially perpendicularly from above, and fit in a corresponding one of the runners 1 and 2. The upright columns 3 and 4 are arranged diagonally at the position of the projected or convex corner in proximity to each other so that one angled edge of the upright column 3 and one angled edge of the upright column 4 confront each other and contact with each other. Consequently, on the inner side (interior side) of the upright columns 3 and 4, there is formed a triangular clearance or space C shaped like a triangle.

Gypsum or plaster boards 7 and 8 as underlay member are fixed, respectively, to outer surfaces of the runners 1 and 2 on the interior side. Each of the gypsum boards 7 and 8 includes a confronting end 7*a* or 8*b* located about the middle of one side surface of a corresponding one of the upright columns 3 and 4 on the interior side. The inner surface of each gypsum board 7 or 8 abuts on the before-mentioned one side surface of the corresponding upright column 3 or 4 and the outer side surface of the corresponding runner 1 or 2. The wall thickness W1 of each gypsum board 7 or 8 is approximately equal to 12.5 mm according to commonly used specifications.

The corner upright column 5 is a long member of a hard synthetic resin formed continuously and integrally by an extruder, for example, and having a sectorial cross section shaped like a fan. The corner upright column 5 includes a base portion 5*a* on a pivot side and an outer end portion 5*b* located on the interior side of the base portion 5*a*. The base portion 5*a* located on the pivot side of the shape of a fan is held and fit in the before-mentioned clearance C. The outer end portion 5*b* projects from the one side surfaces of the upright columns 3 and 4, toward the interior side by an amount corresponding to the wall thickness W of the gypsum boards 7 and 8. Projecting portions 9 and 10, each in the form of a rectangular plate, are formed integrally at both lateral sides of the outer end portion 5*b*.

Each of the projecting portions 9 and 10 is a part of the corner upright column 5, and each projecting portion 9 or 10 extends in the up and down direction, and has a wall thickness W1 substantially equal to the wall thickness W1 of the gypsum boards 7 and 8. An end surface of the projecting portion 9 abuts on the end surface of the end 7*a* of the gypsum board 7. The end surface of the projecting portion 10 abuts on the end surface of the end 8*a* of the gypsum board 8.

The outer end portion 5*b* has an outer surface 5*c* curved in the form of a circular arc up to base ends of the projecting portions 9 and 10. The radius of curvature r of the curved outer surface 5*c* is so determined, in relation to the wall thickness W1 of the gypsum boards 7 and 8, as to form a curved surface continuous with the outer surface 7*b* of gypsum board 7 through the outer surface of the projecting portion 9, and continuous with the outer surface 8*b* of gypsum board 8 through the outer surface of the projecting portion 10. In this embodiment, the radius of curvature r of the curved outer surface 5*c* is equal to about 57.5 mm.

The corner upright column 5 is firmly fixed to the upright columns 3 and 4 by a plurality of countersunk screws 11 and 12 serving as fastening means and a plurality of long countersunk screws 51 and 52. The countersunk screws 11 and 12 are horizontally screwed, respectively, into the projecting portions 9 and 10 from the outer side. The long countersunk screws 51 and 52 are screwed, respectively, from outer side surfaces of the upright columns 3 and 4 on the sides closer to further upright columns 13 and 14.

The gypsum boards 7 and 8 are fastened to the upright columns 3 and 4 by screws 53 and 54 screwed in parallel to the screws 11 and 12, respectively.

The before-mentioned recessed corner upright column 6 is an L-shaped member of a hard synthetic resin formed integrally by extrusion like the corner upright column 5. A triangular vertex portion of the recessed corner upright column 6 is held and fit in a triangular clearance C1 formed between outer side surfaces of the upright columns 3 and 4 on the interior side. The recessed corner upright column 6 includes an end portion 6*a* extending up to a position located about the middle of the outer side surface of the further upright column 13, which is disposed with a spacing corresponding to one column from the upright column 3, and an end portion 6*b* extending up to a position located about the middle of the outer side surface of the further upright column 14, which is disposed with a spacing corresponding to one column from the upright column 4.

The recessed corner upright column 6 has a wall thickness which is set equal to a wall thickness W2 of gypsum boards 15 serving as an underlay member and abutting, respectively, on the end surfaces of the end portions 6*a* and 6*b*. Furthermore, the recessed corner upright column 6 is fastened to the further upright columns 13 and 14 by a plurality of countersunk screws 16 and 17 screwed from the outer sides of the end portions 6*a* and 6*b*.

This recessed corner upright column 6 serves also as a reinforcing member for preventing cracks, vibrations and divergence of fitting in the recessed corner. Moreover, it is possible to make the outer side surfaces of the vertex portion into a curved surface curved like a circular arc as shown by a two dot chain line in FIG. 2, and to increase the strength of the recessed corner upright column 6 by forming the curved surface in this way.

Therefore, this projected corner structure can form an arc-shaped projected corner by fitting and fixing the corner upright column 5 between the two upright columns 3 and 4, and increase the strength of the projected corner sufficiently with the upright columns 3, 4 and 5 which are at least three in number.

In addition, operations for construction are easier since the projected corner structure can be constructed only by assembling the upright columns 3, 4 and 5. By using a standardized versatile member as the corner upright column 5, it is possible to restrain an increase in the cost sufficiently.

The addition of the projected portions 9 and 10 further increases the strength of the corner upright column 5. By setting the wall thickness of the projecting portions 9 and 10 substantially equal to the wall thickness of a standard gypsum board usable as the gypsum boards 7 and 8, it is possible to form the arc-shaped outer surface of the corner upright column 5 and the outer surfaces of gypsum boards 7 and 8 into a smooth continuous outer surface, and therefore, to improve the finished quality of interior material such as vinyl cloth attached to the outer surfaces.

Each of the projecting portions 9 and 10 fits over the corresponding upright column 3 or 4 in a form straddling the corresponding upright column 3 or 4. Therefore, the projecting portions 9 and 10 make it possible to position the corner upright column 5 accurately at the time of construction, and to increase the strength of the entirety by improving the adhesiveness with the upright columns 3 and 4.

The corner upright column 5 is joined to the upright columns 3 and 4 by the countersunk screws 11 and 12. With this joining structure, it is possible to increase the rigidity of the assembly of upright columns 3~5, and to further increase the strength of the projected corner.

Moreover, the recessed corner upright column 6 is provided in addition to the corner upright column 5, and this recessed corner upright column 6 is joined to the further upright columns 13 and 14 by the countersunk screws 16 and 17. Therefore, the recessed corner upright column 6 can increase the strength of the projected corner as a whole in cooperation with the upright columns 3, 4, 13 and 14.

The corner upright column 5 and the recessed corner upright column 6 are formed continuously by extrusion molding. Therefore, it is possible to improve the efficiency of the forming operation and to decrease the cost in terms of the material.

Figure 4:
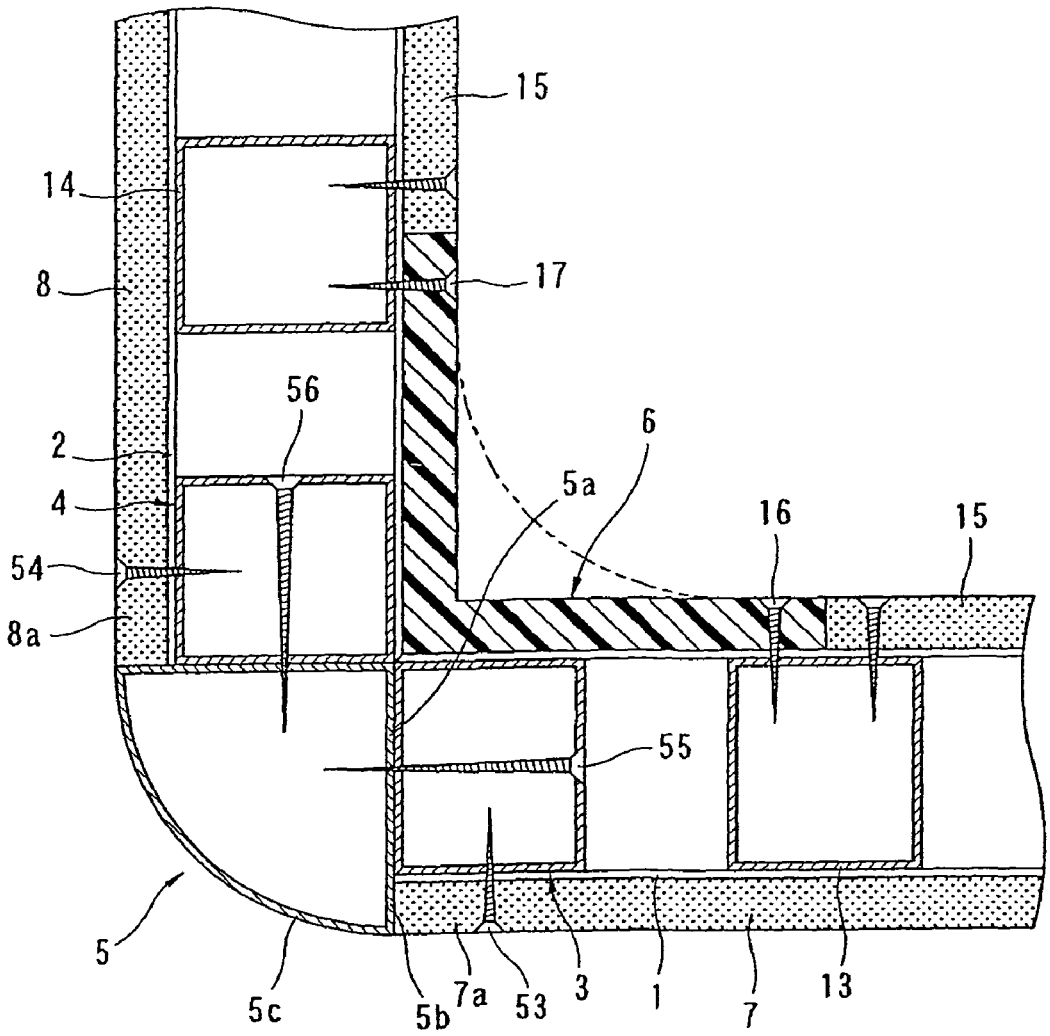
FIG. 4 is a plan view showing a main portion of a second embodiment of the projected corner structure.
Figure 5:
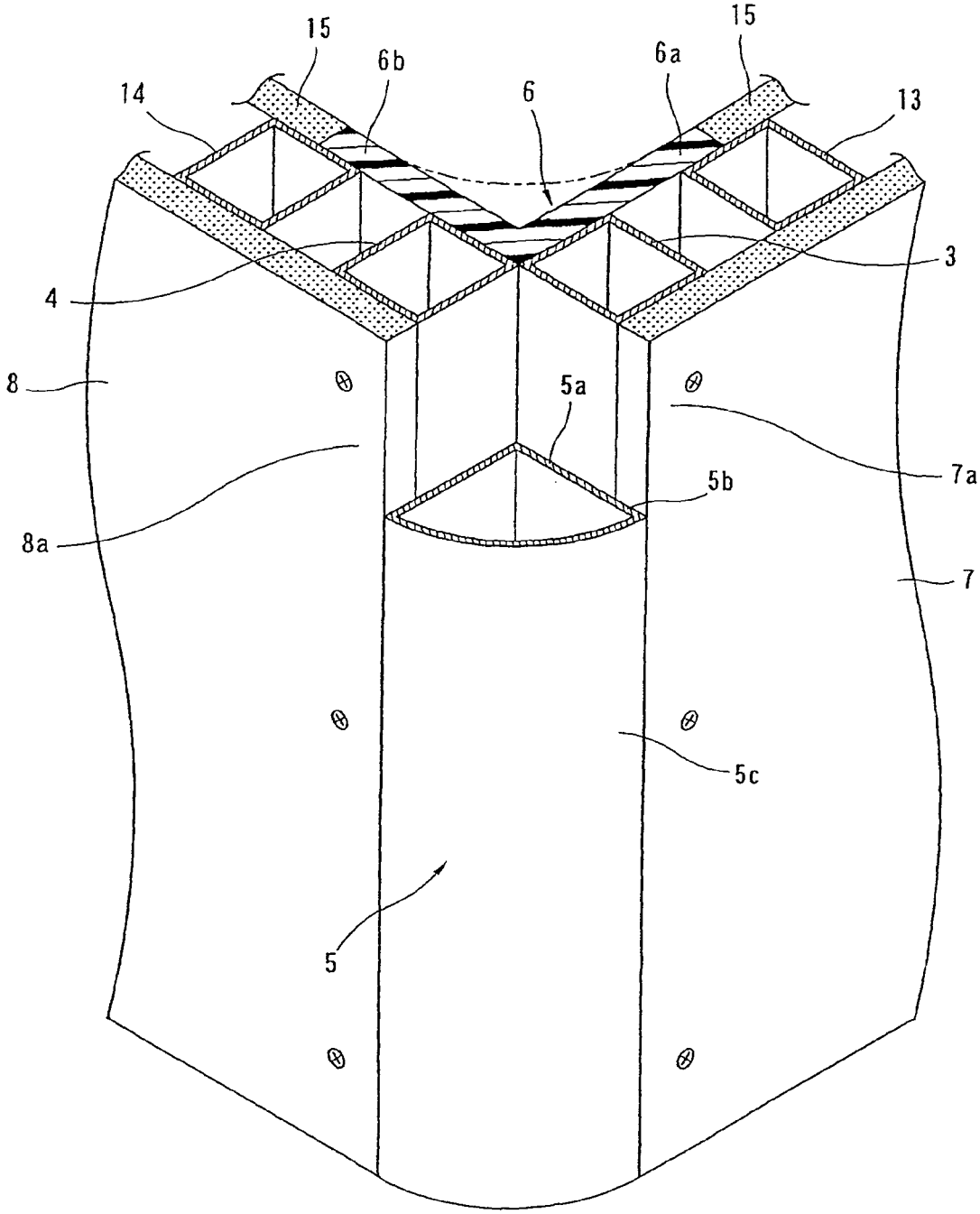
FIG. 5 is a perspective view showing the main portion of the second embodiment.

FIGS. 4 and 5 show a second embodiment in which the corner upright or vertical column or bar 5 is a member of metal sheet or plate such as steel sheet formed by press forming like the upright columns 3 and 4. The corner upright column 5 of the second embodiment is hollow, and has a cross section shaped like a fan in conformity with the before-mentioned triangular clearance C. The outer surface 5*c* of the corner upright column 5 is curved like a circular arc with a radius of curvature equal to the before-mentioned radius of curvature.

In the second embodiment, the projecting portions 9 and 10 are eliminated. Instead, the ends 7*a* and 8*a* of the gypsum boards 7 and 8 extend up to the side surfaces of the outer portion 5*b* of the corner upright column 5, respectively.

The upright columns 3 and 4 and the corner upright column 5 are joined firmly by a plurality of longer countersunk screws 55 and 56, and the upright columns 3 and 4 and the gypsum boards 7 and 8 are joined firmly by a plurality of shorter countersunk screws 53 and 54. In the other respects, the construction of the second embodiment is the same as the construction of the first embodiment.

Accordingly, the second embodiment can provide the same effects as in the first embodiment.

Furthermore, the press-forming process of upright columns 3~5 of metal sheet is easier, and the joined structure by the screws 55 and 56 increases the rigidity of the joined structure and increase the strength of the upright columns 3~5 as a whole.

The hollow corner upright column 5 having an inside cavity can contribute to the reduction of the weight. For the corner upright column 5, it is possible to use widely used material and employ a conventional construction method, so that this embodiment can reduce the cost, and facilitate the construction operations.

Figure 6:
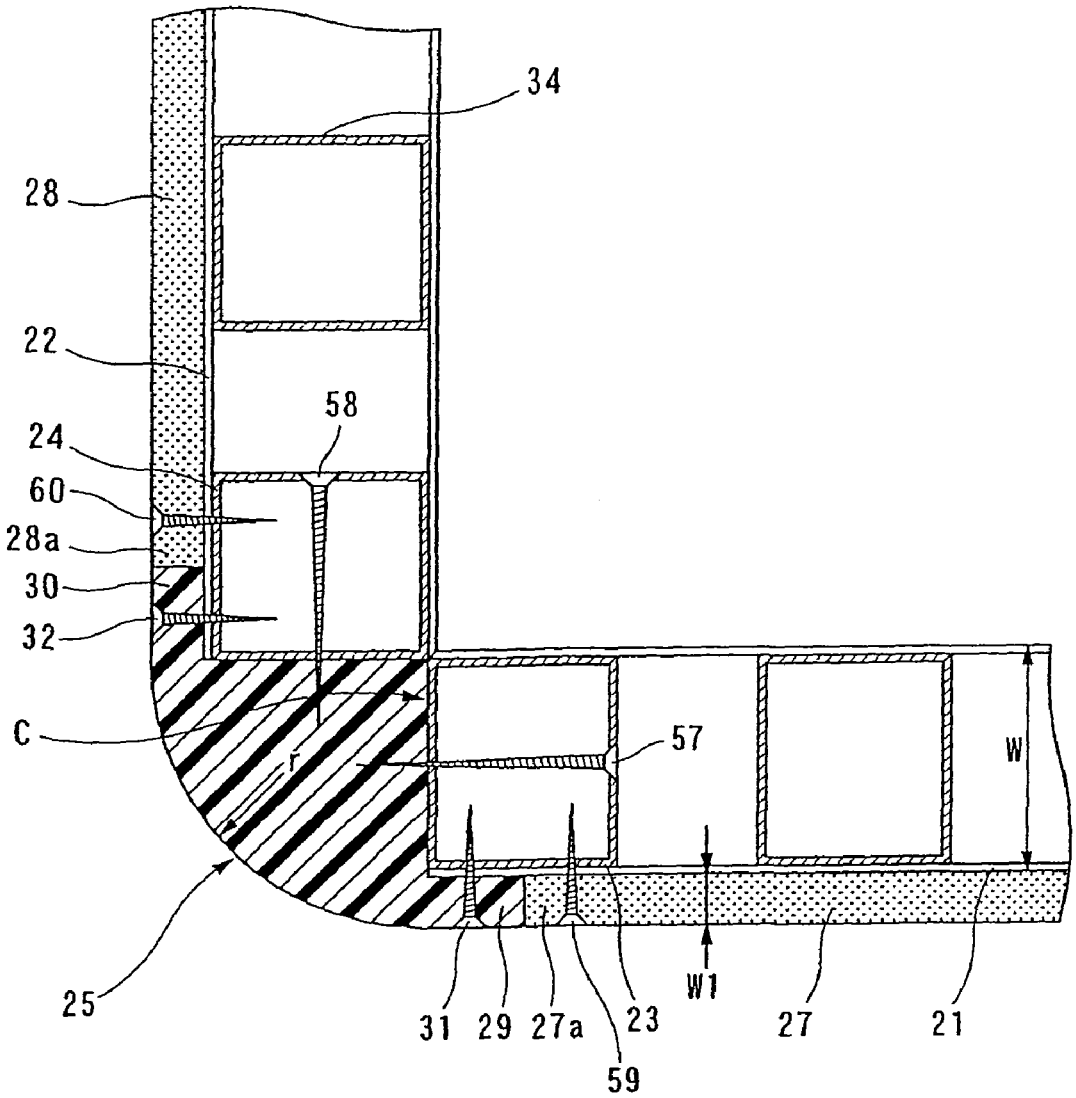
FIG. 6 is a plan view showing a main portion of one embodiment of a projected corner structure according to the invention.

FIG. 6 shows another embodiment of the invention. In this embodiment, the projected corner structure is applied to a hanging wall or partition projecting downwards from a ceiling. In the basic construction, the projected corner structure of this embodiment is substantially identical to the projected corner structure of the first embodiment applied to the upright column.

This projected corner structure includes long straight runners 21 and 22 arranged in an orthogonal state at an upper position in a room, for example; two lateral columns or bars 23 and 24 provided perpendicularly in confronting butting end portions of the runners 21 and 22; and a corner upright column or bar 25 fixed on an interior side or in-room side between the upright columns 23 and 24.

Each of the runners 21 and 22 is a thin metal plate or sheet bent by press forming into a channel which is shaped like a square bracket, which opens laterally and which has a width W approximately equal to 45 mm. Each runner 21 or 22 extends straight between corners. The confronting end portions 21*a* and 22*a* of runners 21 and 22 are arranged substantially at an angle of 90° in a butting state in which the edges of runners 21 and 22 abut each other.

Each of the lateral columns 23 and 24 is a thin metal plate or sheet bent into a shape having a substantially square cross section, and the length of one side is slightly shorter than about 45 mm. Each lateral column 23 or 24 extends straight in a horizontal direction. One end of each lateral column 23 or 24 is inserted substantially horizontally from one side, and fit in a corresponding one of the runners 21 and 22. The lateral columns 23 and 24 are arranged diagonally at the position of the projected or convex corner in proximity to each other so that one angled edge of the lateral column 23 and one angled edge of the lateral column 24 confront each other and contact with each other. Consequently, on the inner side (interior side) of the lateral columns 23 and 24, there is formed a triangular clearance or space C shaped like a triangle.

Gypsum or plaster boards 27 and 28 as underlay member are fixed, respectively, to outer surfaces of the runners 21 and 22 on the interior side. Each of the gypsum boards 27 and 28 includes an end 27*a* or 28*b* located about the middle of one side surface 23*a* or 24*a* of a corresponding one of the lateral columns 23 and 24 on the interior side. The inner surface of each gypsum board 27 or 28 abuts on the before-mentioned one side surface 23*a* or 24*a* of the corresponding lateral column 23 or 24 and the outer side surface of the corresponding runner 21 or 22. The wall thickness W of each gypsum board 27 or 28 is approximately equal to 12.5 mm according to commonly used specifications.

The corner lateral column 25 is a long member of a hard synthetic resin formed continuously and integrally by an extruder, for example, and having a sectorial cross section shaped like a fan. The corner lateral column 25 includes a base portion 25*a* on a pivot side and an outer end portion 25*b* located on the interior side of the base portion 25*a*. The base portion 25*a* located on the pivot side of the shape of a fan is held and fit in the before-mentioned clearance C. The outer end portion 25*b* projects from the one side surfaces 23*a* and 24*a* of the lateral columns 23 and 24, toward the interior side by an amount corresponding to the wall thickness W of the gypsum boards 27 and 28. Projecting portions 29 and 30 each in the form of a rectangular plate are formed integrally at both sides of the outer end portion 25*b*.

Each of the projecting portions 29 and 30 is a part of the corner lateral column 25, and each projecting portion 29 or 30 extends in the up and down direction, and has a wall thickness W1 substantially equal to the wall thickness W of the gypsum boards 27 and 28. An end surface of the projecting portion 29 abuts on the surface of the confronting end of the gypsum board 27. The end surface of the projecting portion 30 abuts on the surface of the confronting end of the gypsum board 28.

The outer end portion 25*a* has an outer surface 25*c* curved in the form of a circular arc up to base ends of the projecting portions 29 and 30. The radius of curvature r of the curved outer surface 25*c* is so determined, in relation to the wall thickness W of the gypsum boards 26 and 27, as to form a curved surface continuous with the outer surfaces 26*b* and 27*b* of gypsum boards 26 ad 27 through the outer surfaces of the projecting portions 28 and 29. In this embodiment, the radius of curvature r of the curved outer surface 25*c* is equal to about 57.5 mm.

The corner lateral column 25 is firmly fixed to the lateral columns 23 and 24 by a plurality of countersunk screws 31 and 32 serving as fastening means and a plurality of long countersunk screws 57 and 58. The countersunk screws 31 and 32 are horizontally screwed, respectively, into the projecting portions 28 and 29 from the outer side. The long countersunk screws 57 and 58 are screwed, respectively, from outer side surfaces of the lateral columns 23 and 24 substantially at a right angle.

The gypsum boards 27 and 28 are fastened to the lateral columns 23 and 24 by countersunk screws 59 and 60 screwed in parallel to the countersunk screws 31 and 32, respectively.

At the side of the upright columns 23 and 24, there are disposed further upright columns 33 and 34 as in the before-mentioned example.

Accordingly, this embodiment can provide a sufficient strength of the projected corner and decrease the cost as in the preceding embodiments, except for the effects of the recessed corner upright column. Furthermore, the arc-shaped outer surface of the corner provides significant changes in environmental space such as softness and expanse of living space, and thereby improve the quality of appearance.

Figure 7:
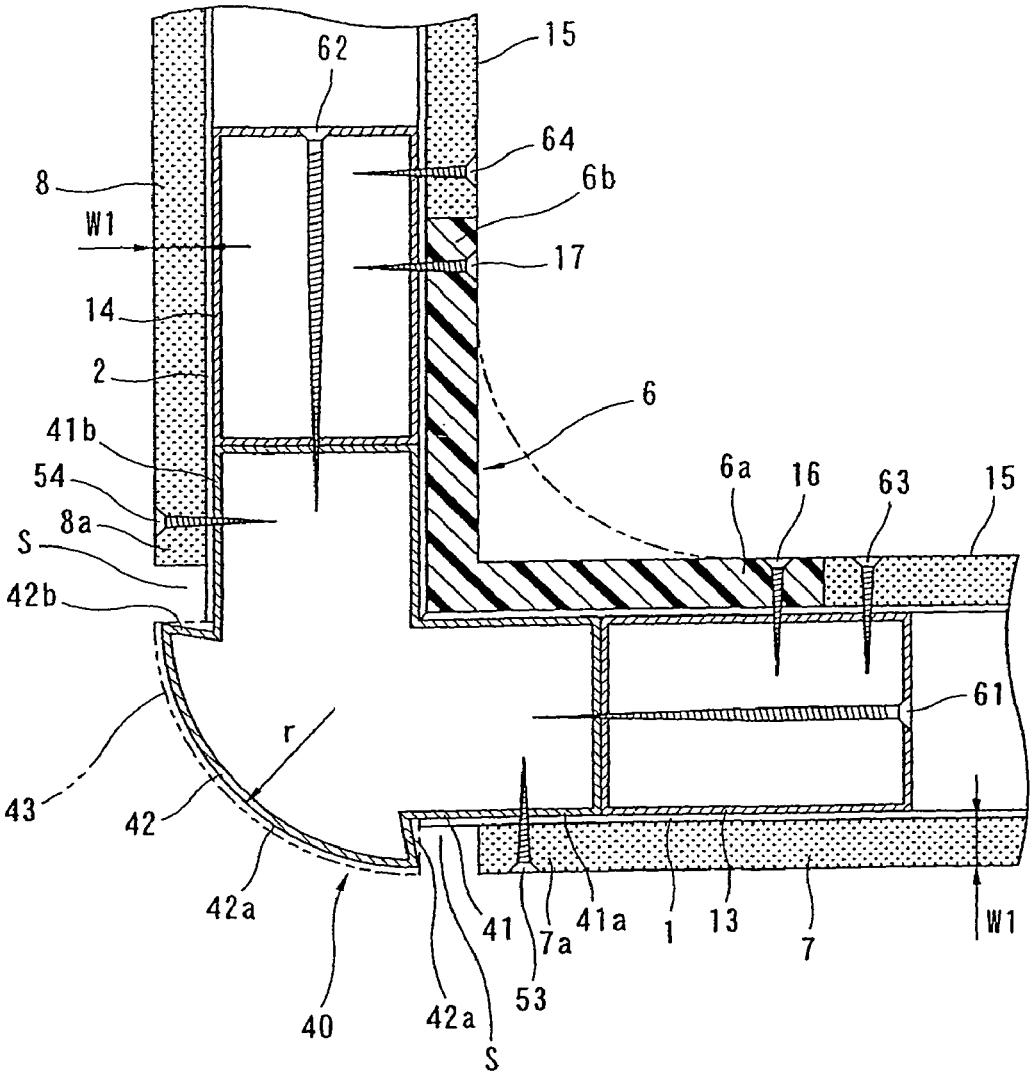
FIG. 7 is a plan view showing a main portion of one embodiment of a projected corner structure according to the invention.

FIG. 7 shows another embodiment of the invention. In this embodiment, a corner upright column 40 has a construction different from that used in the projected corner described previously.

Namely, this projected corner structure is the same as that of the first embodiment in the structure and arrangement of the runners 1 and 2 made of metallic material and formed to have a bracket-shaped cross section, and the recessed corner upright column 6 formed to have an L-shaped cross section. However, the corner upright column 40 standing upright at the confronting butting end portions of runners 1 and 2 is a thin metal plate or sheet bent by press forming into a shape including a main column portion 41 bent into an L-shaped form, and an arc column portion 42 shaped like a fan and formed integrally on the outer side of the main column portion 41.

Each of upright columns 13 and 14 is shaped to have a substantially rectangular cross section. Confronting end surfaces of the upright columns 13 and 14 confronting each other at a right angle abut on outer end surfaces of later-mentioned end portions 41*a* and 41*b* of the main column portion 41, respectively.

The before-mentioned main column portion 41 includes the end portions 41*a* and 41*b* placed so as to form a right angle and each shaped to have a bracket shaped cross section. The end portions 41*a* and 41*b* are fit fixedly in the confronting end portions of runners 1 and 2, respectively.

The upright columns 13 and 14 and the corner upright column 40 are joined together by long countersunk screws 61 and 62 screwed, respectively, from outer end surfaces of upright columns 13 and 14, into the end portions 41*a* and 41*b* of main column portion 41.

The fan-shaped arc column portion 42 projects from the main column portion 41, toward the interior side by an amount corresponding to the wall thickness of the runners 1 and 2 and an amount corresponding substantially to the wall thickness W of the gypsum boards 7 and 8. The arc column portion 42 has an outer surface 42*a* curved in the form of a circular arc along the corner. Each of both end portions 42*a* and 42*b* is bent so as to form a substantially V-shaped form. Borders of the end portions 42*a* and 42*b* are continuous with borders of the main column portion 41, respectively on both sides.

The radius of curvature r of the outer surface 42*a* is so determined, in relation to the wall thickness W1 of the gypsum boards 7 and 8, as to form a curved surface continuous with the outer surfaces 6*b* and 7*b* of gypsum boards 7 and 8. In this embodiment, the curvature radius r of the curved outer surface 42*a* is equal to about 57.5 mm.

Each of the gypsum boards 7 and 8 includes a confronting end 7*a* or 8*a* located about the middle of one side surface of a corresponding one of the end portions 41*a* and 41*b* of the main column portion 41 on the interior side. The end surface of each gypsum board 7 or 8 confronts the corresponding end portion 42*a* or 42*b* across a predetermined clearance S (slit boarding).

The before-mentioned recessed corner upright column 6 is identical in construction to that of the first embodiment. The recessed corner upright column 6 is an L-shaped member of a hard synthetic resin formed integrally. A triangular vertex portion of the recessed corner upright column 6 is held and fit in a triangular clearance C1 formed between outer side surfaces of the end portions of the main column portion 41. End portions 6*a* and 6*b* of the recessed corner upright column 6 are joined to the upright columns 13 and 14 by countersunk screws 16 and 17. It is possible to employ, as the material of recessed corner upright column 6, other materials such as metallic material and wood material.

The gypsum boards 7 and 8 are fastened to the corner upright column 40 by countersunk screws 53 and 54. At the side of the recessed corner upright column 6, gypsum boards 15 are fastened to the upright columns 13 and 14 by countersunk screws 63 and 64.

Therefore, this embodiment makes it possible to form an arc-shaped corner portion in a projected corner with the arc outer surface 42 of the arc column portion 42, and increase the strength of the projected corner sufficiently with the corner upright column 40 integrally formed by the main column portion 41 and arc column portion 42.

Moreover, the strength of the entire projected corner portion is further improved by fitting and fixing the end portions 41*a* and 41*b* of the main column portion 41 directly to the runners 1 and 2, respectively.

The main column portion 41 and arc column portion 42 are formed integrally. Therefore, this embodiment can facilitate the construction and sufficiently restrain cost increase by using, as the corner upright column, a standardized general material. The upright column 40 is hollow. Therefore, this embodiment can decrease the weight, and further facilitate operations for transportation and construction.

As shown by a two-dot chain line, it is possible to attach a cover member 43 of vinyl chloride to the outer surface 42*a* of the arc column portion 42. This cover member can provide robust bonding when a vinyl cloth is attached to this outer surface.

It is possible to make the end portions 7*a* and 8*a* of the gypsum boards 7 and 8 the end portions 42*a* and 42*b* of the arc column portion 42.

Furthermore, it is possible to apply the projected corner structure of this embodiment to the hanging wall shown in FIG. 6, projecting downwards.

Figure 8:
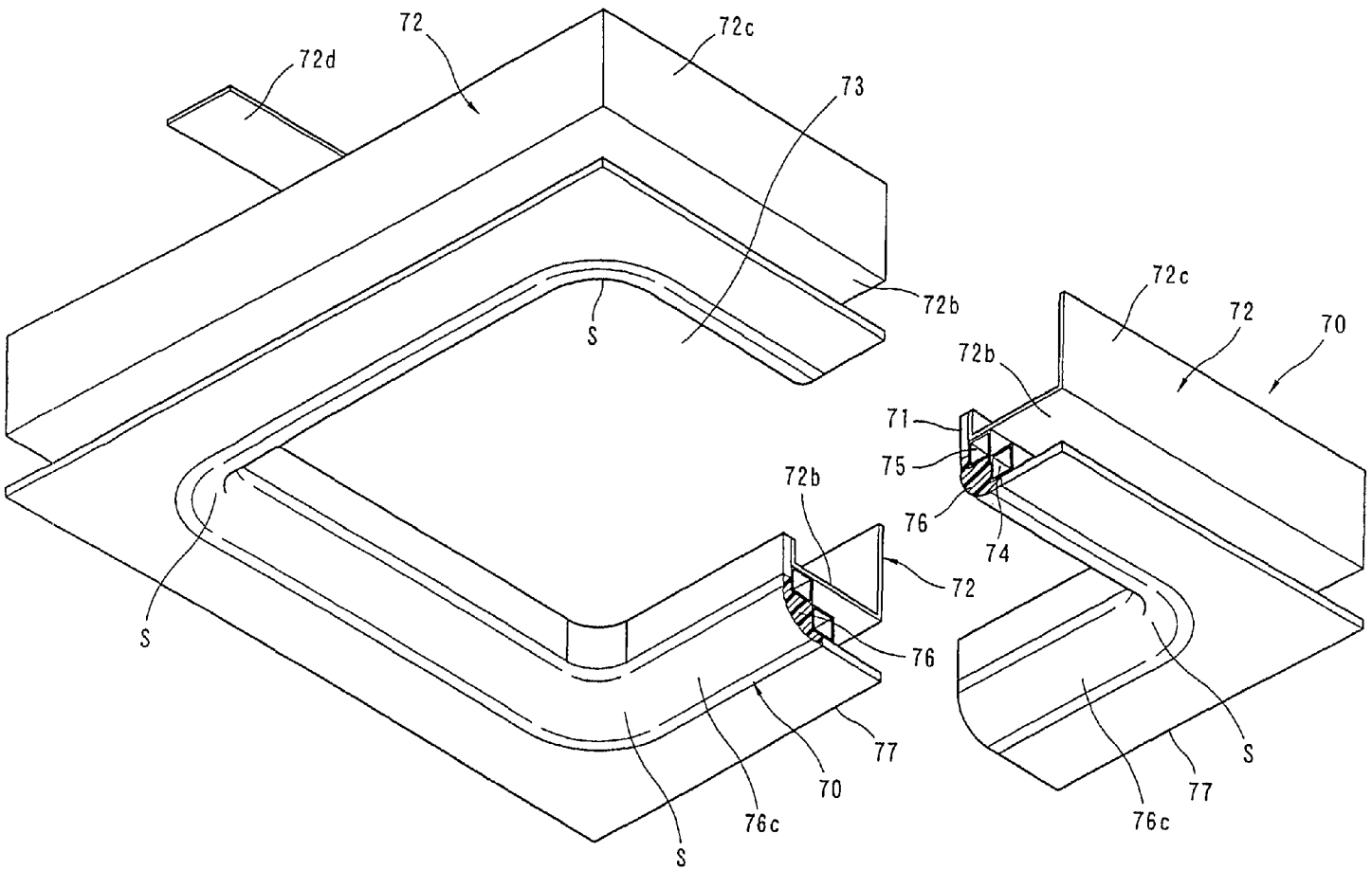
FIG. 8 is a sectional perspective view showing an embodiment of an interior recessed wall structure according to the invention.
Figure 9:
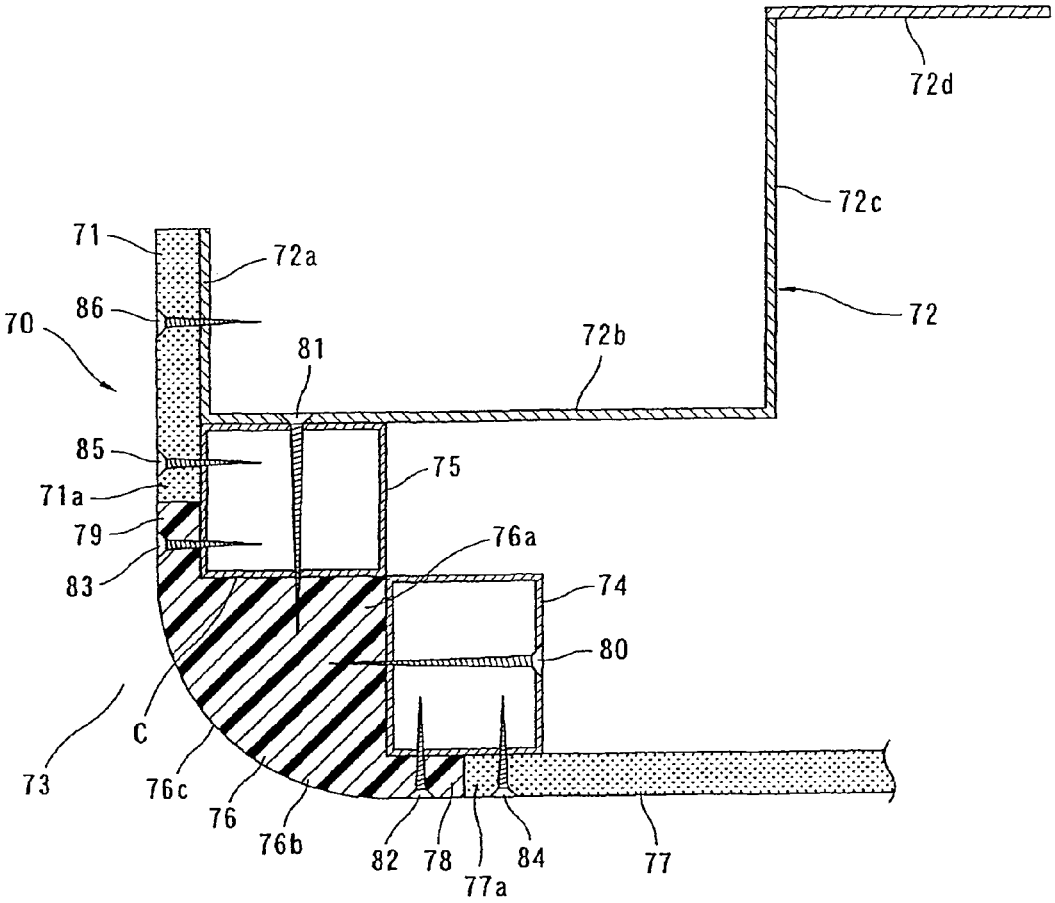
FIG. 9 is a sectional view across a line A-A in FIG. 8.

FIGS. 8 and 9 show one embodiment of an interior or indoor recessed wall structure as recited in Claim 10. This embodiment is applied to a frame or frame body 70 constituting a recessed wall formed in a ceiling for indirect lighting.

The frame 70 is mainly composed of an inner wall 71, a base portion 72, two lateral beam members 74 and 75, a corner lateral beam member 76, and an outer wall 77. The inner wall 71 is shaped like a rectangular frame of a substantially square shape and adapted to be fixed in a recess of the ceiling. The base portion 72 extends from an upper portion of an outer circumferential surface of the inner wall 71, and projecting outwards for supporting lighting equipment. Each lateral beam member 74 or 75 is substantially rectangular in cross section. The two lateral beam members 74 and 75 are arranged in proximity to each other substantially on a diagonal line on a lower inner side of the base portion 72. The corner lateral beam member 76 is fit and fixed in a clearance C having a triangular cross section formed on an outer side between the lateral beams 74 and 75. The corner lateral beam 76 includes an outer surface 76*c* curved like a circular arc. The outer wall 77 extends substantially horizontally and continuously with the lower side of the corner lateral beam member 76. The lateral beam members 74 and 75 and corner lateral beam 76 constitute a border surrounding an opening 73 of the frame 70.

The inner wall 71 is formed by a gypsum board having a predetermined width, for example. The height of inner wall 71 is set equal to a height corresponding to a depth of the recess of the ceiling.

The base portion 72 is formed by press forming of metal material into a form shaped like a square bracket. The base portion 72 includes a base end portion 72*a*, a support surface 72*b* and an upright portion 72*c*. The base end portion 72*a* having a small width is located on the inner side in a manner abutting on the main portion 71. The support surface 72*b* is a flat central part adapted to support lighting equipment such as light bulb so that the light equipment is mounted. The upright portion 72*c* is located on the outer side of support surface 72*b*. The upright portion 72*c* is formed integrally with four long projections 72*d* each located about the middle of the longitudinal direction. The whole of the frame 70 is supported on the ceiling through the projections 72*d*.

The lateral beam members 74 and 75 are formed by bending a thin metal plate or sheet into a form having a substantially square cross section as in the embodiment of FIG. 6, and arranged in the form of a rectangular frame. The angled edges of the lateral beam members 74 and 75 confront each other diagonally and abut against each other.

The corner lateral beam member 76 is an integral member of a synthetic resin. As shown in FIG. 8, the corner lateral beam member 76 is formed in the form of a rectangular frame continuously along the rectangular form of the lateral beam members 74 and 75. The lateral beam member 76 has a sectorial cross section shaped like a fan. The corner lateral beam 76 includes a base portion 76*a* on a pivot side and an outer end portion 76*b*. The base portion 76*a* located on the pivot side is held and fit in the before-mentioned clearance C. The outer end portion 76*b* includes an outer surface 76*c* curved smoothly in the form of a circular arc. This outer surface 76*c* is formed continuously in the form of the circular arc at four corners S.

The corner lateral beam member 76 includes projecting portions 78 and 79 formed integrally on both sides. The projecting portions 78 and 79 project to the outer wall 77 and the inner wall portion 71, respectively. Outer end surfaces of the projecting portions 78 and 79 abut, respectively, on the end surfaces of the confronting end portions 71*a* and 77*a* of the inner and outer wall portions 71 and 77.

The outer wall 77 is formed by a gypsum board like the inner wall portion 71. The outer wall portion 77 extends substantially horizontally to a predetermined length. Furthermore, the lateral beam members 74 and 75 and the corner lateral beam member 76 are joined together by a plurality of long countersunk screws 80 and 81. The projecting portions 78 and 79 of corner lateral beam member 76 are joined, respectively, with lateral beam members 74 and 75, by a plurality of short countersunk screws 82 and 83.

Moreover, the inner wall 71 and outer wall 77 are joined, respectively, with lateral beam members 75 and 74 by short countersunk screws 84 and 85. The inner wall 71 and base portion 72 are joined together by a short countersunk screw 86.

Therefore, in this embodiment, the strength of the structure is improved by the lateral beam members 74 and 75 and corner lateral beam member 76 firmly fit and fixed with one another. Moreover, the curved outer surface 76*c* of corner lateral beam member 76 softens the atmosphere of the ceiling, and provides a comfortable living space.

The invention defined in each claim is not limited to the constructions of the embodiments. It is possible to change the wall thickness of gypsum boards 7 and 8, and to employ gypsum boards of different specifications such as gypsum boards having a wall thickness of 9.5 mm. In this case, the amount of projection of the outer end portion 5*b* of corner upright column 5 and the thickness of the projecting portions 9 and 10 are set to 9.5 mm, so that a smooth and continuous outer surface can be formed.

The corner upright column 5, recessed corner upright column 6 and corner lateral bar 25 may be made of a material, such as synthetic wood, other than synthetic resin and metallic material. As the above-mentioned metallic material, it is possible to employ steel or aluminum alloy.

The invention defined in claim 10 is not limited to the embodiment shown in FIGS. 8 and 9. The recessed wall structure is applicable not only to a recess in a ceiling surface, but also to a recess formed in an inner wall surface inside a room.

The invention claimed is:

1. A projected corner structure for a building, comprising at least two upright columns which are rectangular in cross section and which are disposed in proximity to each other on a diagonal line, and a corner upright column which includes an outer surface shaped in the form of a circular arc and which is fixed upright in a fitting state in a clearance which is formed on an outer side between the two upright columns and which is triangular in cross section;

wherein the two upright columns are first and second upright columns arranged diagonally to form the clearance in the form of a reentrant corner formed by a first flat side of the first upright column and a first flat side of the second upright column, the first flat sides of the first and second upright columns extending to a reentrant edge of the reentrant corner;

wherein the corner upright column includes a sectorial portion, which has a sectorial cross section shaped in the form of a sector of a circle, which is inserted fittingly into the reentrant corner and which includes:

an apex pointing to the reentrant edge, a first lateral side extending from the apex toward a first end of the outer surface of the corner upright column and abutting on the first flat side of the first upright column, a second lateral side extending from the apex toward a second end of the outer surface and abutting on the first flat side of the second upright column, and the outer surface, which is a curved outer surface extending curvedly from the first end to the second end in the form of a circular arc forming the sectorial cross section with the first and second lateral sides, and extending circumferentially from the first end to the second end; and wherein the projected corner structure further comprises a first underlay member extending in a first direction, and a second underlay member extending in a second direction, and the corner upright column includes a first projecting portion projecting from the first lateral side of the sectorial portion in the first direction, to an end confronting an end of the first underlay member, and including an outer surface extending continuously from the first end of the curved outer surface to an outer surface of the first underlay member, and a second projecting portion projecting from the second lateral side of the sectorial portion in the second direction, to an end confronting an end of the second underlay member, and including an outer surface extending continuously from the second end of the curved outer surface to an outer surface of the second underlay member.

2. The projected corner structure of claim 1, wherein the first and second underlay members are provided on outer surfaces of the upright columns, and the corner upright column includes the first and second projecting portions which are provided, respectively, on both lateral sides of the corner upright column, which abut, respectively, on the ends of the first and second underlay members and which include outer surfaces each continuous with the outer surface of a corresponding one of the first and second underlay members.

3. A projected corner structure for a building, comprising:

a first rectangular member extending in a longitudinal direction and including a side wall;

a second rectangular member extending in the longitudinal direction alongside the first rectangular member, and including a side wall forming a recessed angled corner with the side wall of the first rectangular member; and a corner member which extends in the longitudinal direction in the recessed angled corner, which includes a convex curved outer surface, a first side surface abutting on the side wall of the first rectangular member and a second side surface forming a projected angled corner with the first side surface and abutting on the side wall of the second rectangular member so that the projected angled corner formed by the first and second side surfaces of the corner member is fit in the recessed angle corner formed by the side walls of the first and second rectangular members;

wherein the first rectangular member includes first, second, third, and fourth edges extending in the longitudinal direction and forming a rectangular cross section, and first and second side surfaces forming the first edge;

wherein the second rectangular member includes first, second, third, and fourth edges extending in the longitudinal direction and forming a rectangular cross section, and first and second side surfaces forming the first edge of the second rectangular member; and wherein the first and second rectangular members are arranged diagonally so that the first edge of the first rectangular member and the first edge of the second rectangular member abut against each other, and the first side surfaces of the first and second rectangular members define the recessed angled corner in the form of a triangular indentation in which the corner member is fit.

4. The projected corner structure of claim 3, wherein the first and second rectangular members are two lateral bars which are rectangular in cross section, which extend in a horizontal direction and which are disposed in proximity to each other on a diagonal line, and the corner member is a corner lateral bar, which extends in the horizontal direction, which includes the curved outer surface extending curvedly from an upper point to a lower point in the form of a circular arc and which is fixed laterally in a fitting state in a clearance which is formed on an outer side between the two lateral bars and which is triangular in cross section.

5. The projected corner structure of claim 4, wherein the corner lateral bar is made of a hard synthetic resin.

6. The projected corner structure of claim 4, wherein underlay provided on an outer surface of each of the lateral bars, and the corner lateral bar includes projecting portions which are provided, respectively, on an upper side and a lower side of the corner lateral bar, which abut, respectively, on ends of the underlay members and which include outer surfaces each continuous with an outer surface of a corresponding one of the underlay members.

7. The projected corner structure of claim 4, wherein the lateral bars and the corner lateral bar are joined together by fastening means including screw fasteners.

8. The projected corner structure of claim 3, wherein the first and second side surfaces of the corner member form a right-angled salient corner, which projects to an apex and which is inserted into the recessed angled corner formed by the side walls of the first and second rectangular members, and the convex outer surface extends curvedly from a first end to a second end in the form of a quadrant circular arc subtending the right angle formed by the first and second side surfaces emanating from the apex to the first and second end of the convex outer surface, respectively.

9. The projected corner structure of claim 3, wherein the first and second rectangular members are arranged diagonally so that a first side surface of the first rectangular member and a first side surface of the second rectangular member meet each other along a contact line and form a first reentrant corner in the form of a triangular indentation between the first side surfaces of the first and second rectangular members, a second side surface of the first rectangular member and a second side surface of the second rectangular member meet each other along the contact line and form a second reentrant corner in the form of a triangular indentation, which opposes the first reentrant corner and which is formed between the second side surfaces of the first and second rectangular members; and wherein the corner member is fit in the first reentrant corner, and the corner member includes the first side surface abutting on the first side surface of the first rectangular member and the second side surface abutting on the first side surface of the second rectangular member, the first and second side surfaces of the corner member form a salient corner projecting to an apex toward the contact line, and the convex outer surface extends curvedly from a first end to a second end in the form of a circular arc subtending the angle formed by the first and second side surfaces of the corner member emanating from the apex toward the first and second end of the convex outer surface, respectively.

10. The projected corner structure of claim 3, wherein the corner member is a jointless solid member which is entirely made of a resin, and which is an integral product of the resin formed by extrusion.

11. The projected corner structure of claim 3, wherein the first and second rectangular members are two upright columns which are rectangular in cross section and which are disposed in proximity to each other on a diagonal line, and the corner member is a corner upright column which includes the curved outer surface shaped in the form of a circular arc and which is fixed upright in a fitting state in a clearance which is formed on an outer side between the two upright columns and which is triangular in cross section.

12. The projected corner structure of claim 11, wherein the corner upright column is made of a hard synthetic resin.

13. The projected corner structure of claim 11, wherein the upright columns and the corner upright column are joined together by fastening means including screw fasteners.

14. The projected corner structure of claim 11, wherein the two upright columns are distinct members which are not integral with each other, and the corner upright column is fixed to the two upright columns.

15. The projected corner structure of claim 11, wherein the projected corner structure further comprises first and second runners adapted to be fixed to a floor of the building, and arranged to support lower ends of the upright columns, respectively.

16. The projected corner structure of claim 11, wherein the corner upright column includes a projected triangular corner fit in the clearance which is in the form of the recessed angled corner formed by the two upright columns.

17. The projected corner structure of claim 16, wherein the first and second rectangular members are hollow members, and the corner member is a solid member integrally formed of a resin.

18. A projected corner structure for a building, comprising:

a first rectangular member extending in a longitudinal direction and including a side wall;

a second rectangular member extending in the longitudinal direction alongside the first rectangular member, and including a side wall forming a recessed angled corner with the side wall of the first rectangular member; and a corner member which extends in the longitudinal direction in the recessed angled corner, which includes a convex curved outer surface, a first side surface abutting on the side wall of the first rectangular member and a second side surface forming a projected angled corner with the first side surface and abutting on the side wall of the second rectangular member so that the projected angled corner formed by the first and second side surfaces of the corner member is fit in the recessed angle corner formed by the side walls of the first and second rectangular members;

wherein the projected corner structure further comprises:

a first wall structure including an interior board defining a first interior wall surface extending in a first direction; and a second wall structure including an interior board defining a second interior wall surface extending in a second direction;

wherein the corner member includes:

a sectorial portion, which has a sectorial cross section and which is bounded by the first and second side surfaces of the corner member emanating from an apex and abutting on first side surfaces of the first and second rectangular member, and the convex outer surface subtending an angle formed at the apex by the first and second side surfaces of the corner member, a first projecting portion including an outer surface continuous with the first interior wall surface, projecting from the sectorial portion in the first direction along an adjacent side surface of the first rectangular member forming a right-angled edge of the first rectangular member with the first side surface of the first rectangular member, and covering the right-angled edge of the first rectangular member so that the right-angled corner of the first rectangular member is inserted and fit in a right-triangular indentation formed the first projecting portion and the first side surface of the corner member, and a second projecting portion including an outer surface continuous with the second interior wall surface, projecting from the sectorial portion in the second direction along an adjacent side surface of the second rectangular member forming a right-angled edge of the second rectangular member with the first side surface of the second rectangular member, and covering the right-angled edge of the second rectangular member so that the right-angled corner of the second rectangular member is inserted and fit in a right-triangular indentation formed the second projecting portion and the second side surface of the corner member; and wherein the projected corner structure comprises:

the first wall structure, which defines a first wall bounded between the first interior wall surface and a first exterior wall surface extending in the first direction, and which includes the first interior board having the first interior wall surface, a first exterior board extending in the first direction along the first interior board and having the first exterior wall surface, and at least one further upright column disposed between the first interior and exterior boards of the first wall structure;

the second wall structure which defines a second wall extending bounded between the second interior wall surface and a second exterior wall surface and which includes the second interior board having the second interior wall surface, a second exterior board extending in the second direction along the second interior board and having the second exterior wall surface, and at least one further upright column disposed between the second interior and exterior boards of the second wall structure; and an angle member including a first arm extending from an angled edge in the first direction toward an end of the first exterior board, and a second arm extending from the angled edge in the second direction toward an end of the second exterior board, the first rectangular member is disposed between the first arm of the angle member and the first projecting portion of the corner member, and the second rectangular member is disposed between the second arm of the angle member and the second projecting portion of the corner member.

* * * * *